United States Patent [19]

Roberts

[11] Patent Number: 5,000,200

[45] Date of Patent: Mar. 19, 1991

[54] HAIR ROLLER

[76] Inventor: Kenneth B. Roberts, 3832 E. Loyola, Kenner, La. 70065

[21] Appl. No.: 396,060

[22] Filed: Aug. 21, 1989

[51] Int. Cl.[5] ..... A45D 2/00

[52] U.S. Cl. ..... 132/245; 132/247; 132/253; 132/265

[58] Field of Search ..... 132/222, 223, 226, 237, 132/245, 246, 247, 253, 262, 265

[56] References Cited

U.S. PATENT DOCUMENTS

| | | | |
|---|---|---|---|
| 2,892,460 | 6/1959 | Leclabert | 132/265 |
| 3,444,864 | 5/1969 | Glushakow | 132/223 |
| 3,583,409 | 6/1971 | Rios | 132/265 |
| 3,590,829 | 7/1971 | Parisi | 132/226 |
| 3,623,491 | 11/1971 | Garrett | 132/245 |
| 3,683,940 | 8/1972 | Debue | 132/262 |
| 4,022,225 | 5/1977 | Kauffman | 132/223 |
| 4,022,226 | 5/1977 | Muenstermann | 136/245 |
| 4,316,476 | 2/1982 | Merges | 132/253 |
| 4,456,020 | 6/1984 | van Deursen | 132/265 |

*Primary Examiner*—Wilson John J.
*Assistant Examiner*—Frank A. LaViola, Jr.
*Attorney, Agent, or Firm*—Thomas S. Keaty

[57] ABSTRACT

The invention relates to hair rollers and provides for the use of a cylindrical tube rolled from a rectangular sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired.

7 Claims, 1 Drawing Sheet

HAIR ROLLER

BACKGROUND OF THE INVENTION

The present invention relates to personal grooming, and in particular to hair rollers which are used for curling of human hair.

It has been a long practice in hair dressing to curl a person's hair in order to transform straight hair to curly or wavy hair, thus satisfying a specific need or wish of a person to change the appearance of the hair for various reasons. Through the years, various type of rollers have been developed and used by hairdressers, as well as the general public. Traditionally, hair rollers are formed as a cylindrical-shaped tube on which the hair is rolled and after that secured on the roller to remain wrapped thereon for a certain period of time in order to allow the hair to set in its curled up fashion.

Since human hair differs from person to person, and the requirements of a particular person call for various sizes of curl, the companies who manufacture such devices offer various size rollers, that is rollers having various diameters, so as to effect the size of the curl/or wave which can be produced as a result of using the particular type and size of roller. As is often the case, a person needs to buy a number of different sets of rollers, each set having a different diameter tube so as to create various size curls. It becomes especially space consuming, when such sets have to be stored at home. In addition, the purchase of various size rollers involves expenditure of funds to purchase different sets of rollers.

The present invention contemplates provision of a universal hair roller, which can be easily manipulated to change the size of the tube on which the hair is rolled, thus allowing the person an alternative to purchasing and utilizing various sets of rollers.

SUMMARY OF THE INVENTION

The present invention achieves its objects and overcomes shortcomings of the prior art in a simple and straight forward manner. The hair roller of the present invention is formed with a pair of spaced-apart caps, each attached to opposite ends of an elongated shaft. Each of the caps is formed as a circular disk, with an inner surface of each disk having a continuous spiral groove extending from an outer circumference of the disk to approximately the center of the disk. A central opening in the disk frictionally engages one end of the shaft. Each disk is adapted for rotational engagement on the respective end of the shaft. An elongated tube is formed from a rectangular sheet of flexible material, such as plastic, and rolled to form a cylindrical tube. An outer elongated edge of the rectangular sheet overlaps at least a portion of the tube. The length of the outer edge approximates the length of the elongated shaft which carries the disks. The cylindrical tube has opposing transverse edges which are engaged within the spiral grooves of the opposing disks. Rotation of the disks causes advancement of the transverse edges within the spiral groove, rolling the tube into a smaller diameter, thus changing the outer circumference of the cylindrical tube, as desired. Rotation of the disks in the opposite direction causes retraction of the transverse edges of the tube within the spiral groove, thus increasing the outer diameter of the tube.

When making up the hair roller, opposite ends of the longitudinal edge of the tube are engaged within outer ends of the spiral groove, and continuous rotation of the disks causes advancement on the transverse edges within the grooves.

It is therefore an object of the present invention to provide an improved hair roller with means to change the outer diameter of the tube on which the hair is to be rolled.

It is a further object of the present invention to provide a method of making a hair roller with an improved means for changing the outer diameter of the tube on which the hair is to be rolled.

These and other objects of the present invention will be apparent to those skilled in the art from the following description of the invention.

BRIEF DESCRIPTION OF THE DRAWINGS

A reference will now be made to the drawings, wherein like numerals designate like parts, and wherein.

DETAILED DESCRIPTION OF THE PREFERRED EMBODIMENT

Figure 1:
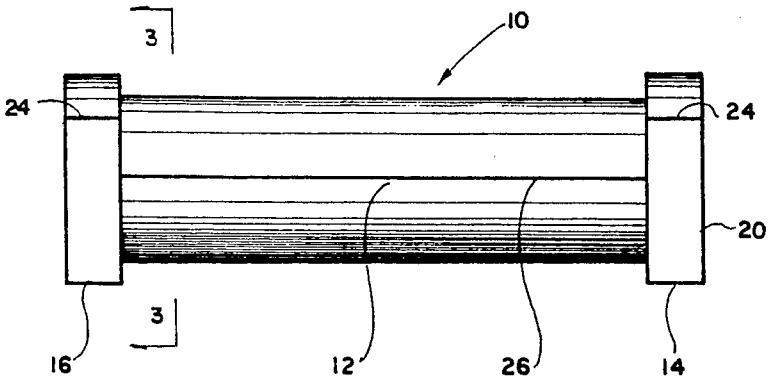
FIG. 1 is a perspective view of the hair roller in accordance with the present invention.
Figure 2:
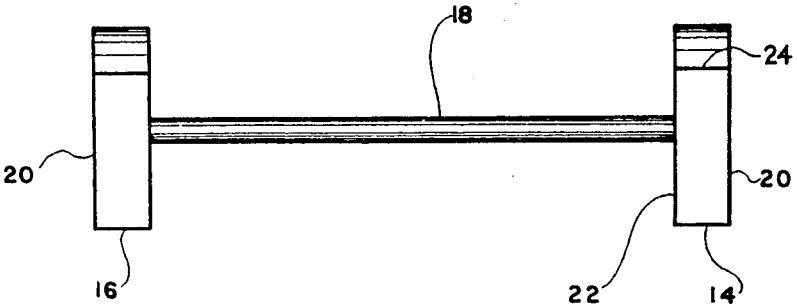
FIG. 2 is a detailed view of the inner shaft of the hair roller in accordance with the present invention.

Referring to the drawings in detail, the hair roller in accordance with the present invention is designated by numeral 10. Hair roller 10 comprises a generally cylindrical sleeve 12, a first cap 14, a second cap 16, both caps detachably secured to the tube 12. The caps 14 and 16 are rotationally secured on opposite ends of an interior shaft 18, as can be better seen in FIG. 2. Each of the caps 14 or 16 is formed circular in shape, with an exterior side 20 and an interior side 22. Formed in the interior side 22 and extending a distance into the thickness of the cap 14 or 16 is a spiral groove 24 which begins on the outer circumference of the cap 14 or 16 and extends in a spiral fashion, terminating adjacent a center of each cap.

As will be appreciated, the noncontinuous circles which are formed by the groove 24 gradually reduce in diameter from the greatest diameter occupied by the groove most adjacent to the outer circumference of the cap 14 or 16, to the smallest diameter adjacent the center of the cap.

The central shaft 18 extends between the two caps, whereby the caps are secured to opposite ends of the shaft 18 at the centers of the caps. A central opening is formed in each of the caps to receive the end of the shaft 18 therein. The opening does not extend through the entire width of the cap and terminates somewhere before it reaches the outer surface or side 20 of the caps 14 and 16. The caps 14 and 16 are adapted for free rotational movement about the shaft 18 and can be completely disengaged from the shaft 18, if so desired.

The sleeve or tube 12 is formed from a substantially rectangular piece of flexible resilient material, such as plastic, and is thermo-processed to retain its generally cylindrical shape. A first outer edge 26 of the sleeve 12 overlaps, to a certain degree, the portion of the tube 12 when shaped into a cylinder. The inner longitudinal edge 28 of the sleeve 12 extends through the length of the tube 12 but on the interior side thereof.

Figure 3:
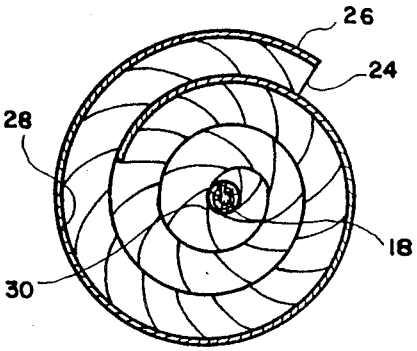
FIG. 3 is a cross sectional view taken along lines 3—3 in FIG. 1.
Figure 4:
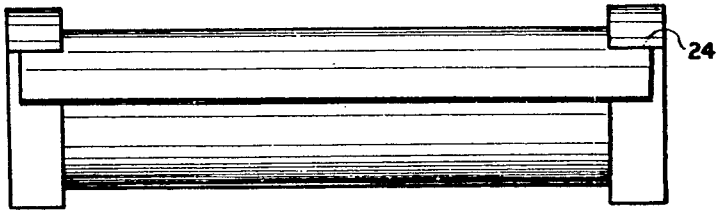
FIG. 4 is a detailed view illustrating a process of combining the elongated sleeve with the caps of the hair roller in accordance with the present invention.

During assembling, the exterior edge 26 is forced into the grooves 24 of the opposite caps 14 and 16 and is engaged therein. By rotating the caps 14 and 16 the tube 12 is forced into engagement with the spiral groove 24, moving the exterior edge 26 towards the center of the cap 30. In this manner the inner edge 28, when the roller unit is assembled, appears adjacent an outermost end of the spiral groove 24. Continuous rotation of the caps 14 and 16 causes the edge 26 further into the groove 24, until it reaches its center, pulling the entire sheet which forms the sleeve 12, and forcing the edge 28 further into the groove 24. In this manner, the tube 12 eventually presents a smaller outside diameter on its outer surface, until it reaches a minimum diameter when the transverse length of the sleeve 12 extends itself through the groove 24. As will be appreciated, the groove 24 in its longitudinal dimension is longer than the transverse length of the sheet from which the sleeve 12 is formed. This allows the tube 12 to be formed of the smallest necessary diameter currently acceptable for the rolling of hair or alternatively, it can assume its less tightly rolled diameter, wherein the edge 28 is adjacent the outermost edge of the groove 24 as illustrated in FIG. 3.

When the necessary diameter tube 12 is reached, through rotation of the caps 14 and 16, the hair roller 10 is used in a conventional manner, that is the hair is rolled on the outer circumference of the tube 12 and is secured by conventional means, such as pins, rubber bands and the like.

The hair roller unit of the present invention is formed of lightweight material such as lightweight plastic, requirements being that the sheet from which the tube 12 is made should be flexible and manageable and retain its outer cylindrical form, that the caps 14 and 16 be made of sufficiently strong plastic to allow cutting of the grooves 24 through substantially entire width thereof, and that their shaft 18 be strong enough to withstand possible bending forces which may be applied to it during rotation of the caps 14 and engaged on the shaft ends.

Alternatively, the shaft 18 can be formed from aluminum or other similar material if desired.

The tube 12 can be made of various colors and textures, while retaining its basic physical shape.

It is preferable that the grooves 24 do no extend to the outside surface 20 of the caps 14 and 16, so as to prevent disengagement and shifting of the tube 12, when secured within the groove 24.

Many changes and modifications can be made within the design of the hair roller in accordance with the present invention without departing from the spirit thereof. I therefore pray that my rights to the present invention be limited only by the scope of the appended claims.

I claim:

1. A hair roller comprising:

a pair of spaced-apart cap means rotationally mounted on opposite ends of elongated shaft means, wherein each of said cap means comprises a substantially circular disc having an outer surface and an inner surface, wherein the inner surface is provided with a central opening for receiving one end of the shaft means in frictional engagement therein;

a substantially cylindrical outer tube means extending between said cap means, wherein said tube means comprises a substantially rectangular flexible sheet rolled into a cylindrical tube, the sheet having an outer elongated edge overlapping at least a portion of the tube, and a first and a second transverse edges; and a means for changing exterior diameter of the tube means carried by said cap means.

2. The device of claim 1, wherein said means for changing exterior of the tube means comprises a continuous spiral groove formed in the inner surface of each disk and extending from an outer circumference of the disk towards approximately a center of each disk, said groove being adapted to receive a transverse edge of said rectangular sheet in frictional engagement therein, and whereby rotation of said disks causes continuous advancement of the sheet along the groove.

3. The device of claim 2, wherein said groove extends from the disk inner surface a distance towards the disk's outer surface.

4. A hair roller comprising:

a pair of spaced-apart cap means rotationally mounted on opposite ends of an elongated shaft means, each of said cap means comprising a substantially circular disk having an outer surface and an inner surface, each disk in the inner surface being provided with a central opening for receiving one end of the shaft means in frictional engagement therein and with a spiral groove extending from an outer circumference of the disk to approximately a center of each disk;

a substantially cylindrical outer tube means extending between said cap means, said tube means comprising a substantially rectangular flexible sheet rolled into cylindrical tube, the sheet having an outer elongated edge overlapping at least a portion of the tube, and a first and a second transverse edges, said transverse edges being received in frictional engagement within the spiral grooves of the opposing disks, and wherein rotation of the disks causes advancement of the transverse edges of the sheet within the spiral groove, thereby changing diameter of the outer tube.

5. The device of claim 4, wherein said groove extends from the disk inner surface a distance towards its outer surface.

6. A method of making a hair roller, comprising the steps of:

providing a pair of spaced-apart cap means rotationally mounted on opposite ends of an elongated shaft means, each of said cap means comprising a substantially circular disk having an outer and an inner surface, wherein the inner surface is provided with a central opening for receiving one end of the shaft means in frictional engagement therein, said inner surface further having a continuous spiral groove extending from an outer circumference of the disk towards approximately a center of the disk;

providing a substantially cylindrical outer tube means extending between said cap means, said tube means comprising a substantially rectangular flexible sheet rolled into a cylindrical tube, the sheet having an outer elongated edge overlapping at least a portion of said tube, and a first and a second transverse edges;

engaging opposite ends of the longitudinal edge within an outer end of the groove;

rotating the disks about the shaft means, gradually advancing transverse edges of the sheet into the grooves of the opposing disks until entire transverse edges of the sheet are engaged within the grooves, forming a cylindrical outer tube of a predetermined diameter.

7. The method of claim 6, further comprising the step of changing diameter of the outer tube by continuous rotation of the disks about the shaft means, causing further advancement of the transverse edges of the rectangular sheet within the grooves of the opposing disks.

* * * * *